United States Patent [19]

Rogalski

[11] 4,284,129

[45] Aug. 18, 1981

[54] BASEBOARD SPACE HEATING, AIR CONDITIONING AND HUMIDITY CONTROL SYSTEM

[76] Inventor: Lawrence D. Rogalski, 20210 Annott, Detroit, Mich. 48205

[21] Appl. No.: 966,205

[22] Filed: Dec. 4, 1978

[51] Int. Cl.[3] ..... F24F 3/00

[52] U.S. Cl. ..... 165/50; 165/60; 237/78 R; 98/30

[58] Field of Search ..... 237/78 R; 165/19, 50, 165/55, 60; 98/30; 126/101

[56] References Cited

U.S. PATENT DOCUMENTS

| | | | |
|---|---|---|---|
| 1,995,667 | 3/1935 | Cano | 165/50 X |
| 2,186,145 | 1/1940 | Perham | 165/60 X |
| 2,198,136 | 4/1940 | Stuart | 237/78 X |
| 2,214,467 | 9/1940 | Lambert et al. | 165/60 X |
| 2,402,488 | 6/1946 | Brown | 237/78 |
| 2,858,077 | 10/1958 | Smith | 98/40 C |
| 2,903,247 | 9/1959 | Kritzer | 165/55 |
| 3,265,305 | 8/1966 | Johnson | 237/78 |
| 3,789,918 | 2/1974 | Rogalski | 165/60 |

*Primary Examiner*—Lloyd L. King
*Assistant Examiner*—Henry Bennett

[57] ABSTRACT

An integrated baseboard heating, air conditioning and humidity control system comprises a hollow baseboard having an air conditioning discharge vent and a separate heating and humidifying compartment, the air conditioning vent being connected by a duct system to an air conditioner unit, the heating/humidifying compartment receiving a baseboard heater, a humidification water pan adjacent the heater and a condensation drip pan below the humidification pan, the humdification system including parallel cold and hot water branches, and the heater and hot water humidity systems having separate hot water heaters. The parallel cold and hot water humidification system branches are rejoined into a single water conduit supplying the humidification water pan and controlled by a float-controlled valve and/or a solenoid-operated water flow valve, the water pan overflow conduit to waste including a flow switch valve that senses water flow therethrough and operates to close the solenoid water flow valve in response to excessive waste water flow. The humidification water pan is formed with a hot air vent extending upwardly therethrough with means to divert hot air through a porous absorbent element in the pan to increase humidity in the heated space. The hollow baseboard has air inlet and outlet vents and a hinged front panel to provide access to the heating/humidifying compartment.

13 Claims, 11 Drawing Figures

BASEBOARD SPACE HEATING, AIR CONDITIONING AND HUMIDITY CONTROL SYSTEM

BRIEF SUMMARY OF THE INVENTION

This invention relates to a residential or other space heating, air conditioning (A/C) and humidification system, and more particularly to a baseboard system having certain improvements over prior art systems.

Baseboard room heating systems are usually hot water, steam or electric systems, and one disadvantage thereof, as compared to ducted hot air heating systems, is that there is no duct to accommodate an air conditioning system.

In most forced air heating-A/C systems, there is a common duct for heated air and air conditioning, but the heated air-A/C vent is relatively small since it emerges into the room from a duct normally disposed between joists or studs and the length of the vent does not exceed the width of the duct. This is also true in systems having separate A/C ducts. Such a small vent has the disadvantage of poor heat-A/C distribution, as compared to heat distribution of baseboard heating where the heater extends substantially along a room wall.

While evaporative baseboard humidification systems are known, certain improvements are desirable to increase the efficiency and reliability thereof.

Accordingly, a main object of the invention is to overcome these and other disadvantages of prior art heating/air conditioning/humidification systems.

More specifically, a main object of the invention is to provide a baseboard heating system having provision for an air conditioning vent substantially co-extensive with the baseboard heater for better A/C distribution.

Still another object of the invention is to provide a system wherein the humidification water may be selected between cold water and heated water, as desired.

Another object is to provide such a system wherein the humidification water is heated by a source other than the heat source for the space heater.

A further object of the invention is to provide a system having control means wherein humidification feed water is cut off on failure of the water control means, as indicated by excessive overflow to waste.

A further object of the invention is to provide an elongated hollow baseboard having a heat/humidification compartment with a hinged panel providing access thereto and an A/C cold air discharge vent having a hinged air flow-directing cover and extending substantially the entire length thereof.

These and other objects and advantages of the invention will become more apparent upon reference to the following specification and the appended drawing.

DETAILED DESCRIPTION

Figure 1:
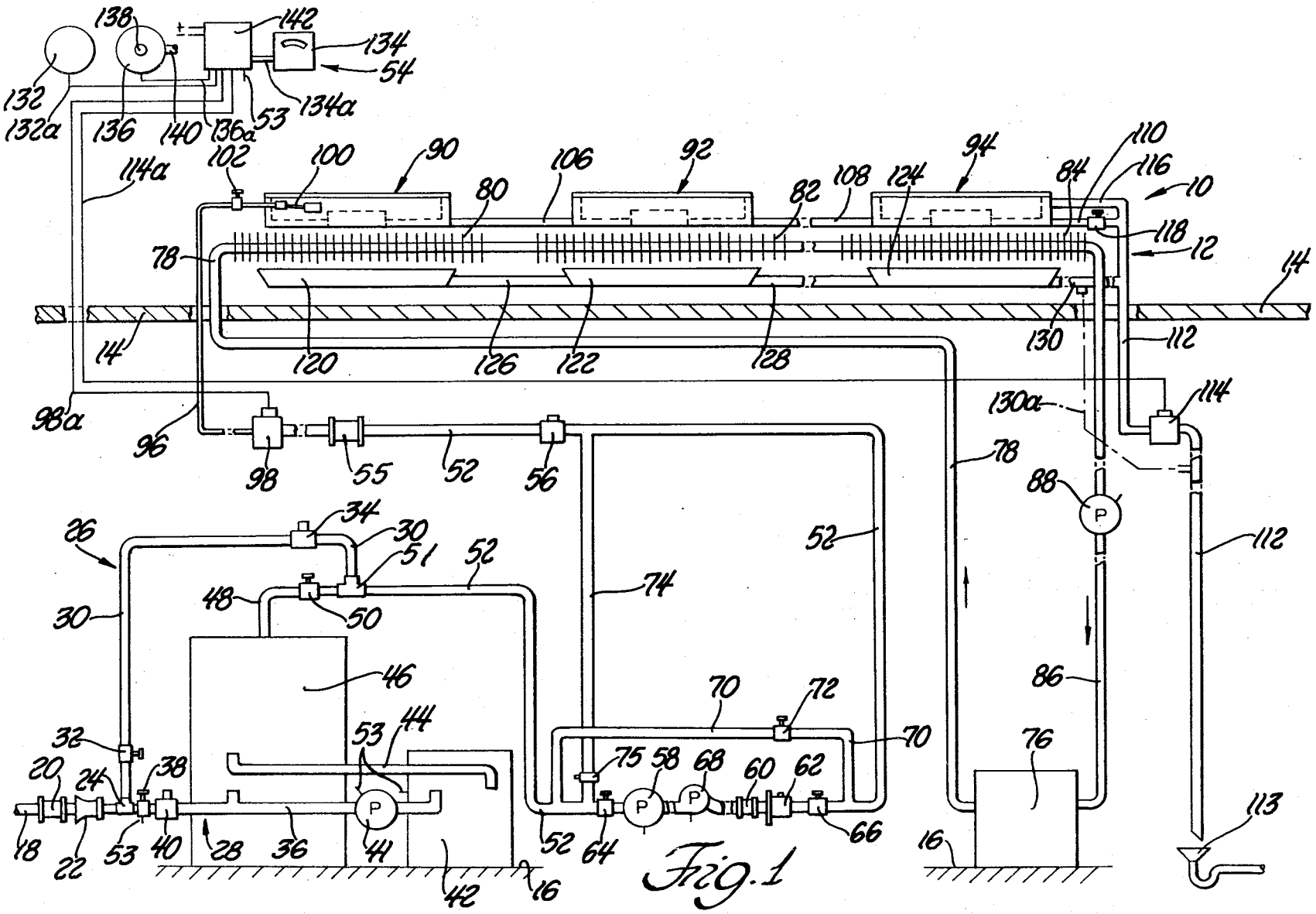
FIG. 1 is a schematic illustration of a heating-/humidification system embodying the invention.

Referring now to the drawings in greater detail, FIG. 1 illustrates schematically the heating/humidification portion 12 of an integrated heating/humidification/air conditioning system 10 embodying the invention, as it would appear in a vertical section taken through a residential or other building, wherein 14 is the first floor and 16 is the basement floor.

Beginning in the lower left-hand corner of FIG. 1, a cold water supply line 18 may include a filter 20 and a pressure reduction valve 22 ahead of the T fitting 24, which provides parallel water circuits 26 and 28.

Circuit 26 is a cold water circuit, and it includes the conduit 30 having control gate valve 32 and check valve 34, which prevents back flow of hot water into conduit 30. When cold water humidification is desired, either as part of the humidity control means or for energy conservation, for example, gate valve 32 would be opened.

Circuit 28 is a hot water circuit, and it includes cold water conduit 36, control gate valve 38, check valve 40, electric circulating pump 41 and water heater 42. Hot water conduit 44 delivers water heated in heater 42 to hot water storage tank 46, and hot water conduit 48 delivers hot water from tank 46, when gate valve 50 therein is open, to conduit 52 to which conduit 30 of cold water circuit connects at T fitting 51.

From the above description, it is apparent that conduit 52 conducts either cold or hot water, or a mixture thereof, depending upon the extent to which gate valves 32, 38 and 50 are open.

As stated, if cold water humidification is desired, then gate valves 38 and 50 would be closed and gate valve 32 would be opened. Closing of gate valve 38 could be arranged to automatically turn off circulating pump 41 and heater 42, through leads 53 connected to electrical control system timer 142, to conserve energy and wear of these elements.

If hot water humidification is desired, then cold water gate valve 32 is closed and hot water circuit gate valves 38 and 50 are opened. Opening of gate valve 38 may turn on circulating pump 41 and heater 42. Check valves 34 and 40 prevent back flow of hot water into the cold water circuit. Of course, heater 42 may be controlled to provide any desired water temperature. It will be apparent that the capacity of heater 42 and storage tank 46 will depend mainly upon the size of the humidification system—that is, the number and size of the rooms to be humidified, etc.

Referring now again to conduit 52, cold or hot humidification water therein is circulated to balancing cock 56, which is manually set to the desired water flow, by electric circulating pump 58 through filter 60, check valve 62 and gate valves 64 and 66. Where the distance or the height to which the water must be pumped is such as to require it, an electric centrifugal pump 68 may be included in conduit 52.

Conduit 52 includes valves 64 and 66 in order to enable maintenance of the pumps 58 and 68, conduit 70 providing a bypass around pumps 58 and 68 and including a gate valve 72 that is normally closed. In the event of pump or other repair, for example, valves 64 and 66 can be closed and valve 72 can be opened to open the bypass conduit 70.

Conduit 74 provides a return from the upstream side of balancing cock 56 to the inlet side of circulating pump 58, upstream of the gate valve 64, so that any excess flow is recirculated. Humidification water passing through balancing cock 56 passes through a filter 55 and then to solenoid valve 98, the purpose and operation of which will be explained. Check valve 75 prevents backflow in conduit 74.

Before proceeding further with the description of the heating/humidification system 12, the heating system portion thereof will now be described. A boiler or heater 76, which may be of any suitable construction, is adapted to provide a heating medium, such as hot water or steam, which is conducted through conduit 78 to one or more finned-tube heaters 80, 82 and 84, which are the usual baseboard heaters positioned along outer walls of the building. Any number of such heaters may be connected in series, as shown, or they may be connected in parallel. In the series arrangement shown, conduit 86 returns the heating medium to the boiler or heater 76. An electric pump 88 may be provided, if desired, to circulate the heating medium. Further heater detail is not important to the invention, it being noted that heaters 80, 82 and 84 could also be electric baseboard heaters, in which case, boiler 76 and conduits 78 and 86 are not required. In any case, the room is heated by convection of air heated by the heaters.

Returning again to the humidification portion, humidification is provided by evaporation of water from a humidity pan disposed adjacent or above each of the heaters 80, 82 and 84. In the series arrangement shown in FIG. 1, the pans 90, 92 and 94, which will be described in greater detail, are mounted at essentially the same horizontal level. Water is supplied to the pans through the conduit 96 the flow through which is controlled, in one modification of the invention, by a solenoid valve 98, the operation of which will be described.

The level of water in pans 90, 92 and 94 may be controlled by a conventional float valve 100 in pan 90, and a gate valve 102 is provided in the event it is desired to shut off the supply of water to the humidification pans, as for maintenance purposes. Conduits 106 and 108 connect pans 90, 92 and 94 and conduit 110 discharges from pan 94 to a waste conduit 112, which discharges to drain 113, through a flow switch valve 114, the purpose of which will be described. Conduit 116 is an overflow, when gate valve 118 is closed, to prevent the pans from overflowing in the event, for example, of failure of the float valve 100, and/or the solenoid valve 98. Conduit 110 drains the pans when gate valve 118 is opened, for which purpose the pans and connecting conduits 106 and 108 may slope slightly from pan 90 to pan 94.

Positioned generally beneath each humidification pan and heater, is a drip pan of sufficient dimension to catch any overflow or condensation from the humidification pan above it. The drip pans 120, 122 and 124 are connected by conduits 126 and 128, all of which are preferably sloped toward pan 124 and conduit 130 then discharges any water therein to return conduit 112. Conduit 130 may be connected to return conduit 112 downstream of flow switch valve 114, as shown by broken line 130*a*, to eliminate condensation from the flow sensed by valve 114.

Referring now to the humidification system controls 54, it will be seen in the upper left-hand portion of FIG. 1, that there is provided a humidistat 132, a heat/A/C thermostat 134, a solenoid failure alarm 136 and lamp 138 having a reset 140 and a timer and power control 142.

The solenoid valve 98, the flow switch valve 114, the humidistat 132, the thermostat 134, and the alarm/signal light/reset 136/138/140 are all electrically connected (by electrical connections 98*a*, 114*a*, 132*a*, 134*a* and 136*a*) to the timer so as to provide the control described below.

The thermostat 134 operates in the conventional manner, to select heat or A/C, as desired. The humidistat 132 is set for the desired humidity, and, whenever the room humidity falls below the set desired value, the timer 142 operates to energize and open the solenoid valve 98 for the brief time sufficient to fill the pans 90, 92 and 94. In case of solenoid valve 98, timer control 142 or other malfunction, resulting in excessive flow in conduit 112 and through flow switch valve 114, valve 114 operates to cut off electrical power from timer 142 to solenoid valve 98, which is open only when power is supplied thereto, and valve 98 closes.

In the latter event, the alarm/signal light 136/138 is also activated. When the malfunction is corrected, the reset 140 is operated to reset timer to normal function. If it is desired to drain the humidity pans for some reason, which results in excessive flow through valve 114, the timer 142 must be shut off to avoid activating the alarm/light 136/138.

The system 12 preferably includes either the float valve 100 or the solenoid valve 98 and other controls 54, but not both. If the float valve 100 controls pan water level, then the humidity level in the room is simply dependent upon constant evaporation from the humidity pans. If there is no float valve 100, as suggested by the broken lines in FIG. 3, then humidity is controlled by the humidistat 132, timer 142 and solenoid valve 98, as explained in operation of controls 54.

Figures 2, 3, 4, 5, 6:
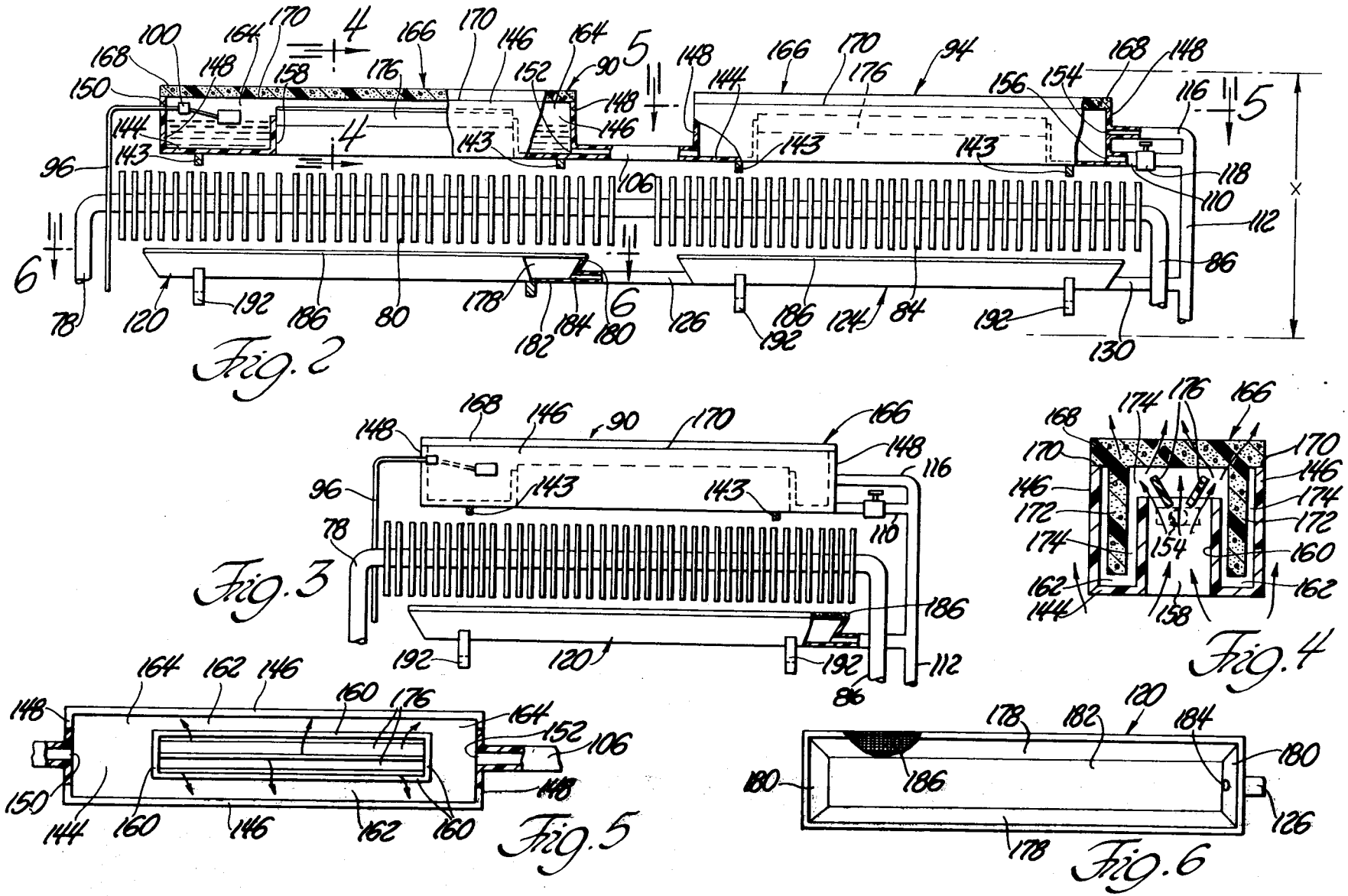
FIG. 2 is an enlarged side elevational view of a portion of the heating/humidification system shown by FIG. 1.
FIG. 3 is a view similar to FIG. 2 illustrating a single heater configuration of the system shown by FIG. 1.
FIG. 4 is a further enlarged cross-sectional view taken on the plane of line 4—4 of FIG. 2, looking in the direction of the arrows.
FIG. 5 is a top plan view taken in the plane of line 5—5 of FIG. 2, looking in the direction of the arrows.
FIG. 6 is a top plan view taken in the plane of line 6—6 of FIG. 2, looking in the direction of the arrows.

FIG. 3 illustrates a single heater/humidification pan/drip pan arrangement, such as might be the case for a single smaller room system, or in parallel connection of a plurality of radiators, etc., from the heater 42 and hot water tank 46 and the boiler 76. Like parts in FIG. 3, as in all of the Figures, are identified with the same or similar reference numerals. Of course, the FIG. 1 control system 54 would be applicable.

FIG. 2 is a dual series arrangement, with portions thereof cut away and in cross-section to better illustrate the invention, sections being taken in FIG. 2 for FIGS. 4, 5 and 6.

Figure 10:
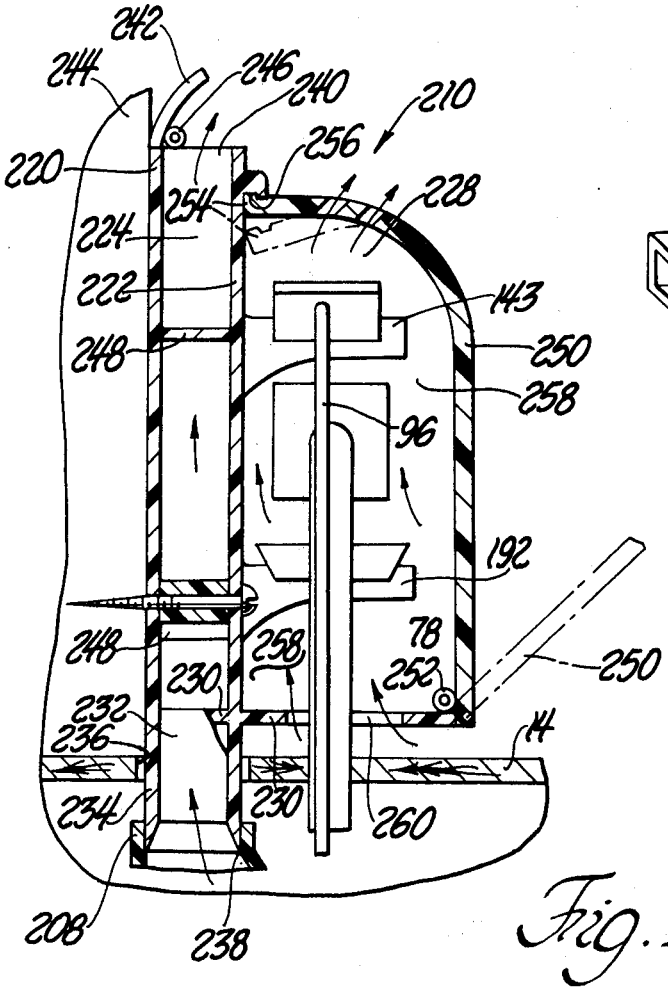
FIG. 10 is a cross-sectional view, taken on the plane of line 10—10 of FIG. 9, looking in the direction of the arrows.

It will be seen from FIGS. 2–5 that the humidification pans, such as pans 90, 92 and 94, and the conduits connected to and between the same, are preferably formed from a non-corrodible construction plastic material, such as polyvinylchloride (PVC), for example. Such pans may be supported by a suitable bracket 143, as also shown in FIG. 10.

Each humidification pan is formed with a bottom wall 144, opposite side walls 146 and opposite end walls 148. The pans 90 first receiving water are fitted with the float valve 100 and formed with an inlet 150 to accommodate the supply conduit 96 and an outlet 152 for drain conduit 106. The last pans 94 in series (the single pan of FIG. 3) are formed with outlets 154 and 156 to accommodate the overflow conduit 116 and the drain conduit 110, respectively. A typical humidification pan dimension might be as 18–24" long, 2½" wide and 2" deep, but the invention is not so limited.

It will be noted that each humidification pan (90, 92, 94) is formed with a bottom opening 158, from which an integral continuous wall 160 extends upwardly into the pan to form side and end channels 162 and 164, respectively, with the side walls 146 and end walls 148 of the pans. The top of wall 160 extends into the pan to a position above the overflow outlet opening 154 in the last pan 94, so that the water level in the pan cannot normally flow over the wall 160. However, should water flow over wall 160 for any reason, it will be caught in the drip pan, and the alarm 136/138 will be activated as explain above.

As shown in FIGS. 2 and 4, an absorbent, porous block 166 made of any suitable non-corrodible material is disposed in each pan. The block 166, which is removed in FIG. 5, is formed with a horizontal top portion 168 of sufficient dimension to rest on the top edges 170 of the pan and depending spaced wall portions 172 adapted to be received in the side channels 162 and 164, there being clearance 174 between portions 172 and the pan walls to facilitate absorption of water by the block 166. The block material is sufficiently porous so that heated air can rise therethrough and pick up and carry moisture for humidification purposes. The float valve 100 is disposed between wall portions 172 of block 166 in pan 90.

The top of the wall 160 carries spaced fins 176 (see FIGS. 2, 4 and 5) to deflect heated air laterally to a greater area of the top 168 of the block 166, as shown by the arrows in FIGS. 4 and 5, thus increasing humidification efficiency.

Figure 7:
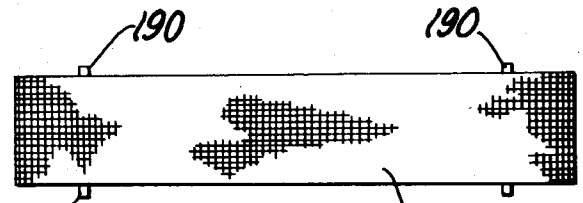
FIG. 7 is a top plan view of an element of the invention.

FIG. 6 is a top plan view of a drip pan, specifically the left end drip pan 120 of FIGS. 1 and 2, or the pan 120 in FIG. 3, for example. Each drip pan 120, 122 or 124 is of sufficient length and width to catch any accidental water overflow or condensation dripping from the humidification pan above it, the sides 178 and ends 180 thereof being preferably sloped upwardly and outwardly from the bottom 182 thereof. One end of pan 120 is formed with a drain outlet 184 to accommodate drain conduit 126. Intermediate drip pans, such as pan 122, are formed with an outlet 184 at each end. A fine screen 186, with retaining means such as lugs 190, is preferably fitted on each drip pan, as shown in FIGS. 3, 6 and 7, to keep out lint and dust which might clog the drain passages, such as conduits 126. Brackets 192 may be employed to support the drip pans, as also shown in FIG. 10.

Figure 8:
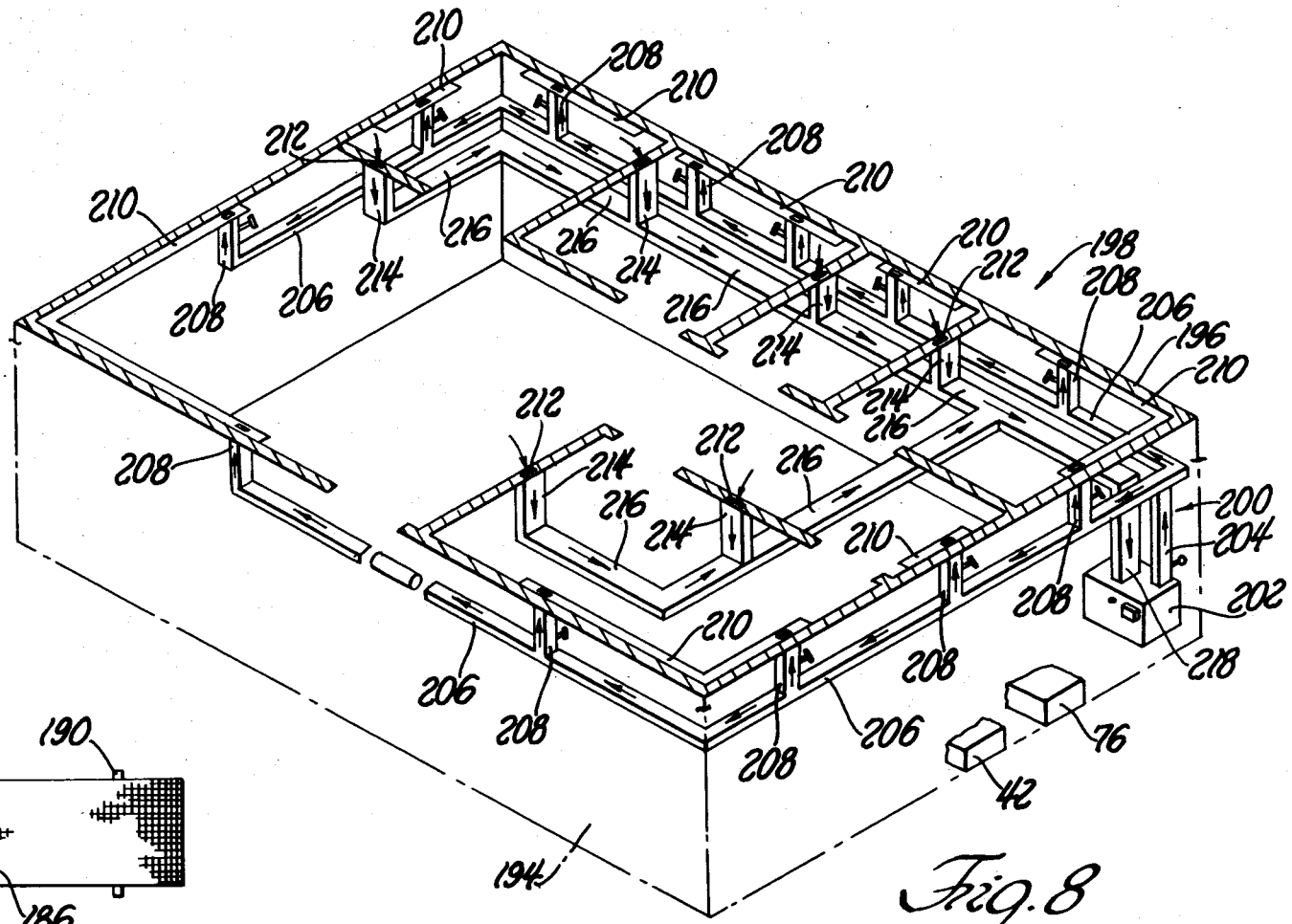
FIG. 8 is a schematic perspective view illustrating elements of the air conditioning portion of the invention.
Figure 9:
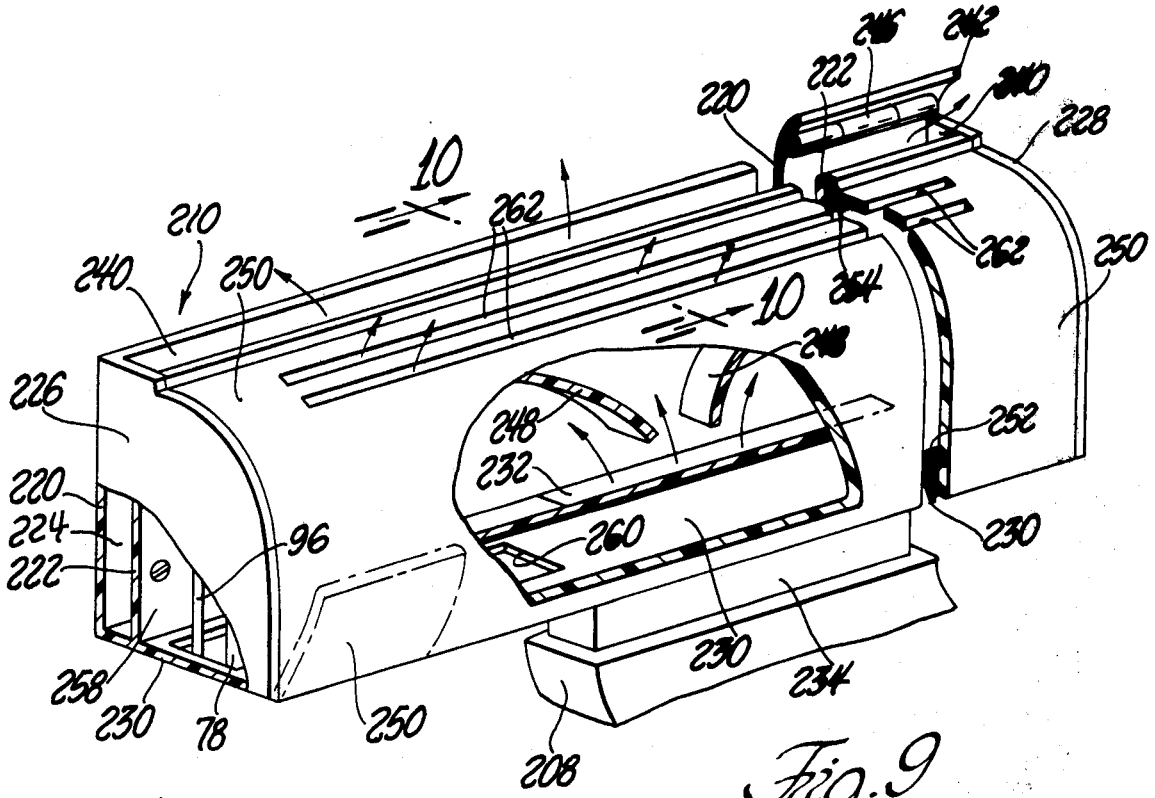
FIG. 9 is an enlarged perspective view, with portions thereof broken away and in cross-section, illustrating a hollow baseboard embodying the invention.
Figure 11:
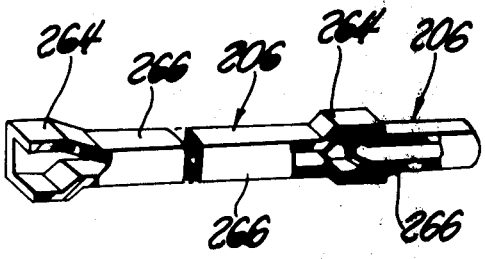
FIG. 11 is a reduced side elevational view, with portions broken away and in cross-section, of an element of the invention.

The above is a description of a portion of the heating-/humidification system of the invention. The A/C and other portions of the invention will now be described. To briefly summarize, FIG. 8 is a schematic perspective view of an air conditioning system portion that embodies the invention. FIG. 9 is an enlarged perspective view of a baseboard embodying the invention, and FIG. 10 is a still further enlarged cross-sectional view through FIG. 9. Finally, FIG. 11 is a cutaway side elevational view of plastic ducts contemplated by the invention.

Detailed reference is now made to FIG. 8, which illustrates a basement 194 and first floor 196 of a building 198. The basement contains the heater 42 and boiler 76 illustrated in FIG. 1, but, for purposes of simplification of the drawing, the remainder of the heating-/humidification system 12 already described above is not shown in FIG. 8.

The air conditioning system 200 comprises an A/C unit 202, which may be of any design and the compressor element of which is normally located outside the building. The vertical main cool air supply duct 204 carries cool air from the unit 202 to the horizontal perimeter ducts 206. The perimeter ducts 206 feed the riser ducts 208, which feed cool air to the perimeter baseboards 210.

Vents 212 admit return air to vertical ducts 214, which feed horizontal return air ducts 216. The latter discharge return air to the main vertical duct 218 that carries return air to the unit 202.

It is seen more clearly in FIGS. 9 and 10 how cool air riser ducts 208 connect to the baseboard 210 to provide an integrated baseboard heating/air conditioning-/humidification system. To better understand the integrated system 10, it is preferable to first describe the baseboard structure 210 by reference to FIGS. 9 and 10.

Specifically, the baseboard 210 comprises an elongated hollow structure having a rear vertical wall 220 and an intermediate wall 222 spaced from the rear wall so as to provide a cool air passage 224 therebetween the extends substantially the entire length of the baseboard 210 between the ends 226 and 228 thereof. The walls 220 and 222 extend upwardly from a bottom wall 230, in which an opening 232 is formed for each cool air riser duct 208. There may be more than one such openings in each baseboard. A baseboard opening connector duct 234 extends below the bottom wall 230 of the baseboard a sufficient distance so that it extends below the floor 14 through the floor opening 236 therefor, for connection to a riser duct 208.

Since it is contemplated that the baseboard cool air passage 224 will be relatively narrow, the top of riser duct 208 may be tapered to telescopingly receive the narrower baseboard connector duct 234, or vice versa. In any event, the constriction at the connection 238 has the venturi effect of increasing the velocity of the cool air flow therethrough.

The baseboard walls 220 and 222 form a cool air discharge slot 240 along the length of the baseboard 210. The rear wall may have a portion 242 extending above the slot 240, such portion being curved, if desired, to direct cool air away from the room wall 244, as shown by the arrows. Further, portion 242 may be secured to wall 220 by a hinge 246, so that slot 240 can be closed thereby when A/C is not desired.

Preferably, air directing vanes 248 are formed in the cool air passage 224 to direct some of the cool air flowing upwardly through opening 232 toward the ends of the cool air discharge slot 240, as shown by the arrows in FIG. 9. The vanes are separated so that some of the air flows upwardly between the vanes.

The front wall 250 of the baseboard 210 is curved downwardly near the top thereof toward the bottom wall 230 and connected thereto by hinge means 252, the elements of which may be formed integrally with the front and bottom walls. The baseboard 210 is preferably formed from a plastic material having sufficient flexibility so that the top edge of the front wall 250 may be formed with a bead 254 adapted to snap into a mating groove 256 at the top of the intermediate wall 222 to retain the same in closed position, as shown in solid lines in FIGS. 9 and 10. When access to the heater/humidification compartment 258 of the hollow baseboard is desired, the bead 254 can be depressed and the wall 250 rotated to the open position, as shown in broken lines in FIGS. 9 and 10.

It will be seen from FIGS. 9 and 10 that the compartment or chamber 258 is foreward of, and separate from, the cool air passage 224 of baseboard 210 and that it contains the heating and humidification system components already described above. That is, the heater/-humidification pan/drip pan elements are disposed within chamber 258, which has an inner height of dimension X of FIG. 2, the humidification and drip pans (and the heaters, if desired) being retained by brackets 143 and 192, which may be formed integrally with the wall 222.

It will be further noted that the bottom wall 230 is formed with bottom inlet slots or opening 260 for entry of air to be heated and that the top of the front wall 250 is formed with outlet slots 262 for heated air, the convection air flow being as shown by the arrows.

FIG. 11 illustrates the manner in which some of the A/C ducts, such as ducts 204, 206, 216, etc., including elbows and the like, may be formed with female 264 ends. With such double hub construction, if a conduit is cut, it automatically provides a duct with one female 264 end and one male end 266. Of course, other ducts may be formed with male ends 266.

It is contemplated that most of the elements of the heater/humidifier/air conditioner system 10, such as the ducts, humidifier conduits, pans and baseboards will be formed from suitable plastic materials, such as PVC, for example, and that they will be assembled by cementing the same with a suitable glue or cement. Cementing the ducts will provide an air-tight duct system.

The air conditioner system, like the heating system, can be any suitable system, the control of which can be by the usual "Heat-Off-Cool" wall-mounted thermostat switch, such as thermostat 134. Thus, those details of construction of the heating and air conditioning systems not described herein are not critical to the invention. It is contemplated, however, that the A/C system is preferably a relatively high pressure, leak proof, forced-air system, which enables use of smaller ducts, where A/C is to be added to an existing building.

It will be apparent from the above detailed description that the invention provides an integrated baseboard heating/humidification/air conditioning system, in which a baseboard includes the heating and humidification system and the air conditioner cool air discharge passage and vent. With elongated baseboard discharge of cool air, it is distribued more evenly in a room, like baseboard heat.

Certain features of the invention are not limited to the integrated system, but may be used in any humidification system. For example, humidification is with the use of either cold or heated water, and the heated water is heated by a heater separate from the heating system heater or boiler, thus isolating the two heating units where that is desired or required. Selection of cold water operation cuts off the water heater and circulation pump and vice versa.

Also, where humidification is controlled by a humidistat that controls admission of water through a solenoid valve to a humidification pan (or pans), anytime that there is excessive waste water flow, a flow switch valve cuts off electrical power to the solenoid valve to close the same, to stop water flow therethrough. At the same time, an alarm and light is activated to alert the home owner or maintenance personnel of a failure.

The invention has been shown and described in such clear and concise terms as to enable anyone skilled in the art to practice the same. While preferred embodiments have been disclosed, other changes may be made within the scope of the invention, and no limitations are intended except as recited in the appended claims.

What I claim as my invention is:

1. An integrated baseboard/humidification/air conditioning system, comprising an elongated baseboard having a heater/humidification compartment and a separate air conditioning passage, said heater/humidification compartment having at least one baseboard heater element supported horizontally therein, with a humidification pan supported adjacent said heater element and a drip pan supported below said humidification pan, said humidification pan comprising an open-top pan having a bottom wall and oppositely disposed end walls and side walls, said pan having disposed therein a porous absorbent block adapted to absorb water and allow passage of air therethrough and a walled opening in said bottom wall through which air heated by said heater element may rise to said porous block.

2. An integrated baseboard/humidification/air conditioning system, comprising an elongated baseboard having a first heater/humidification compartment and a separate second air conditioning passage, said first compartment having at least one baseboard heater element supported horizontally therein, a humidification pan supported adjacent said heater element and a drip pan supported below said humidification pan, said humidification pan comprising an open-top pan having a bottom wall and oppositely disposed end walls and side walls, said pan having disposed therein a porous absorbent block adapted to absorb water and allow passage of air therethrough, said bottom wall of said pan being formed with an opening from which a wall extends upwardly into said pan, whereby said pan comprises a continuous channel defined at the outer periphery thereof by said end and side walls and at the inner peripherhy thereof by said wall extending from said opening, said absorbent block having an upper portion extending across said open-top pan and portions extending into said channel.

3. The system in claim 2, wherein air deflecting vanes extend across said inner peripheral wall near the top thereof to distribute air flowing upwardly through said opening from said heater element through said upper portion of said absorbent block.

4. The system of claim 2, wherein said heating system includes a first heater and said humidification system comprising a water circuit including a cold water source supplying cold water to parallel cold and hot was conduit branches, said hot water branch including a second water heater separate from said first heating system heater and a hot water storage tank, said branches merging in a first common conduit connected to supply water to said humidification pan, and overflow and drain conduits connected to said humidification pan and merging in a second common waste conduit discharging to a drain.

5. The system of claim 4, having means for selecting between said cold and hot water branches.

6. The system of claim 4, wherein said drip pan is formed with a drain conduit connected to said common waste conduit.

7. The system of claim 4, wherein said first common supply conduit includes at least one pump means, pump bypass means, balancing cock means and a return to the inlet of said pump.

8. The system of claim 4, wherein said first common supply conduit includes a solenoid-operated water flow control valve and said second common waste conduit includes a flow switch valve.

9. The system of claim 7, said system having an electrical control system including a source of electrical power, a timer control, a heat/cool thermostat, a humidistat, said solenoid valve, said flow switch valve and a control system failure alarm and signal lamp with reset, said control system being arranged so that said heat/cool thermostat actuates said heating or said air conditioning system, as desired, said humidistat causes said solenoid valve to pen when an increase in humidity is desired and said flow switch valve senses waste flow therethrough and causes said solenoid valve to close by cutting off electrical power thereto when excessive waste flow is sensed and activates said alarm and signal lamp.

10. A system such as that recited in claim 4, wherein said humidification pan includes float controlled water inlet valve means to control the level of the humidification water supplied thereto, the humidification system being a constant evaporation system wherein humidification occurs so long as there is water in said humidification pan.

11. The system of claim 4, wherein there are a plurality of said baseboard heater/humidification pans/drip pan combinations connected in series, the upstream humidification pan being connected to said water supply and the downstream humidification and drip pans being connected to said overflow and drain conduits, said drains being connected at the bottom of said pans and said overflow being connected to said humidification pan at a level below the top of said inner peripheral wall surrounding said bottom wall opening thereof.

12. A humidification system for a hot water baseboard heating system including an elongated baseboard heat radiator connected to a heat source and a control therefor, said humidification system comprising first water evaporation means and second humidification control means, said first means including a source of cold water, a water heater, a first humidification pan, a second drip pan and a drain, said source including a supply conduit having a first branch connected to supply cold water to said heater and to supply heated water from said heater and a second branch bypassing said heater to supply cold water, said first and second branches supplying a single humidification water supply conduit downstream from said heater and having means to select between cold or hot water, said first pan comprising an open-top water container disposed adjacent said radiator so as to receive heat therefrom and said second pan being disposed below said first pan so that it will receive any condensation moisture dripping from or humidification water spilling from said first pan, said single conduit being connected to supply cold or hot water to said first pan, a float controlled valve to sense and control the maximum water level in said first pan, a waste water conduit for discharging waste water to said drain, an overflow conduit connecting said first pan and said waste water conduit and drain conduits connecting said first and second pans and said waste water conduit, whereby all water not evaporated for humidification can be discharged to drain, said control means comprising a source of electrical power, a power/timer control, a heat and humidity selector control, a solenoid water control valve in said single conduit, a flow switch control valve in said waste conduit, a water heater control and a failure alarm, said control means elements being connected electrically so that when an increase in humidity is required, the solenoid valve will be energized open to supply humidification water to said first pan, said switch valve sensing the quantity of water flow therethrough and being adapted, upon excessive flow, to de-energized and close said solenoid valve and to activate said alarm.

13. The system recited in claim 12, wherein said first pan comprises a bottom wall and a peripheral outer wall having opposite side and end portions, said bottom wall having an opening therein and an inner peripheral wall extending upwardly therefrom with opposite side and end portions parallel to said portions of said outer wall, the top of said inner wall being above the level of said overflow conduit but below the top of said outer wall, said inner and outer walls forming a continuous water channel having opposite side and end portions, and a block of absorbent porous material disposed in said first pan, said block having a top portion resting on the top of said outer wall to cover said first pan and spaced parallel depending portions disposed with clearance in said side portions of said water channel, the float of said float-controlled valve being disposed between said depending portions, said inner wall having vanes formed to deflect hot air therethrough from said radiator over a greater area of the lower surface of said block so as to improve humidification efficiency.

* * * * *